US010306396B2

(12) United States Patent
Romigh

(10) Patent No.: US 10,306,396 B2
(45) Date of Patent: May 28, 2019

(54) COLLABORATIVE PERSONALIZATION OF HEAD-RELATED TRANSFER FUNCTION

(71) Applicant: The United States of America, as represented by the Secretary of the Air Force, Washington, DC (US)

(72) Inventor: Griffin D. Romigh, Dayton, OH (US)

(73) Assignee: United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 15/957,876

(22) Filed: Apr. 19, 2018

(65) Prior Publication Data

US 2018/0310115 A1 Oct. 25, 2018

Related U.S. Application Data

(60) Provisional application No. 62/487,127, filed on Apr. 19, 2017.

(51) Int. Cl.
*H04R 5/02* (2006.01)
*H04R 5/00* (2006.01)
(Continued)

(52) U.S. Cl.
CPC ..... *H04S 7/303* (2013.01); *H04S 3/008* (2013.01); *H04S 2420/01* (2013.01)

(58) Field of Classification Search
CPC ..... H04S 7/303; H04S 3/008; H04S 2420/01
(Continued)

(56) References Cited

U.S. PATENT DOCUMENTS 5,742,689 A 4/1998 Tucker et al.
6,181,800 B1 1/2001 Lambrecht
(Continued)

FOREIGN PATENT DOCUMENTS

WO WO9725834 7/1997
WO WO2015017914 2/2015
(Continued)

OTHER PUBLICATIONS

R. Baumgartner et al., "Modeling sound-source localization in sagittal planes for human listeners," J. Acoust. Soc. Amer., vol. 136 (2014) 791-802.

(Continued)

*Primary Examiner* — William J Deane, Jr.
(74) *Attorney, Agent, or Firm* — AFMCLO/JAZ; Chastity Whitaker

(57) ABSTRACT

An improved methodology for binaural rendering of audio signals that are perceived by a user to originate from a real-world spatial location is disclosed. Embodiments enable personalized HRTF selection from among a data store containing a plurality of candidate HRTFs using an evaluation-based personalization strategy. One or more relational models personalize the selection. These relational models can relate candidate HRTFs to each other and a particular user to other users so that only a subset of the candidate HRTFs require evaluation. Candidate HRTFs can be evaluated according to one or more selection policies, and relational models can be updated based on actual responses from a user to virtual audio signals that are rendered by a candidate HRTF.

20 Claims, 5 Drawing Sheets

(51) Int. Cl.

| | |
|---|---|
| ***H04R 7/00*** | (2006.01) |
| ***H04S 7/00*** | (2006.01) |
| ***H04S 3/00*** | (2006.01) |

(58) Field of Classification Search
USPC ..... 381/303, 17
See application file for complete search history.

(56) References Cited

U.S. PATENT DOCUMENTS

| | | | | |
|---|---|---|---|---|
| 6,768,798 | B1 | 7/2004 | Dempsey | |
| 7,209,564 | B2 | 4/2007 | Jin et al. | |
| 8,428,269 | B1 | 4/2013 | Brungart et al. | |
| 8,768,496 | B2 * | 7/2014 | Katz | H04S 3/002 700/94 |
| 8,805,692 | B2 | 8/2014 | Goldstein | |
| 9,030,545 | B2 | 5/2015 | Pedersen | |
| 9,173,032 | B2 | 10/2015 | Brungart et al. | |
| 9,426,589 | B2 | 8/2016 | Udesen | |
| 9,584,942 | B2 | 2/2017 | Satwell | |
| 9,609,436 | B2 | 3/2017 | Gamper et al. | |
| 9,788,135 | B2 | 10/2017 | Romigh | |
| 2008/0137870 | A1 | 6/2008 | Nicol et al. | |
| 2008/0306720 | A1 | 12/2008 | Nicol et al. | |
| 2012/0183161 | A1 | 7/2012 | Agevik et al. | |
| 2013/0046790 | A1 * | 2/2013 | Katz | H04S 3/002 707/792 |
| 2015/0156599 | A1 | 6/2015 | Romigh | |
| 2015/0373477 | A1 * | 12/2015 | Norris | H04M 1/72572 381/303 |
| 2017/0164085 | A1 | 6/2017 | Romigh | |
| 2018/0249274 | A1 * | 8/2018 | Lyren | H04S 7/303 |

FOREIGN PATENT DOCUMENTS

| | | |
|---|---|---|
| WO | WO2016134982 | 9/2016 |
| WO | WO2017041922 | 3/2017 |

OTHER PUBLICATIONS

F. T. Bruss, "Sum the odds to one and stop," Annals of Probability, vol. 28 (2000) 1384-1391.
R. Duraiswami et al., "The manifolds of spatial hearing," Acoustics, Speech, and Signal Proc., vol. 3 (2005).
A. Harma et al, "Personalization of Headphone Spatialization Based on the Relative Localization Error in an Auditory Gaming Interface," Audio Eng. Soc. Conven., vol. 132. (2012).
S. Li et al., "Collaborative filtering bandits." Proc. 39th Int'l ACM SIGIR Conf. Res. and Devel. Information Retrieval, ACM (2016).
D. J. C. Mackay, "Information-based objective functions for active data selection," Neural Computation, vol. 4 (1992) 590-604.
T. Nishino et al., "Interpolating head related transfer functions in the median plane," Appl. Signal Proc. Audio and Acoustics, (1999).
S. L. Scott, "A modern Bayesian look at the multi-armed bandit," Appl. Stochastic Models in Business and Industry, vol. 26 (2010) 639-658.
S. Weerahandi, "Generalized confidence intervals." J. Amer. Statistical Assoc., vol. 88 (1993) 899-905.
S. Xu et al., "Individualization of head-related transfer function for three-dimensional virtual auditory display: a review." Int'l Conf. Virtual Reality. Springer Berlin Heidelberg (2007).
F. Cacheda et al., "Comparison of collaborative filtering algorithms: Limitations of current techniques and proposals for scalable, high-performance recommender systems." ACM Transactions on the Web (TWEB), vol. 5 (2011) 2.

* cited by examiner

COLLABORATIVE PERSONALIZATION OF HEAD-RELATED TRANSFER FUNCTION

RIGHTS OF THE GOVERNMENT

The invention described herein may be manufactured, used, and licensed by or for the Government of the United States for all governmental purposes without the payment of any royalty.

Pursuant to 37 C.F.R. § 1.78(a)(4), this application claims the benefit of and priority to prior filed co-pending Provisional Application Ser. No. 62/487,127, filed Apr. 19, 2017, the disclosure of which is hereby incorporated by reference in its entirety.

FIELD OF THE INVENTION

The present invention relates generally to binaural rendering of audio signals utilizing head-related transfer functions and, more particularly, to an improved methodology that provides efficient personalized HRTF selection.

BACKGROUND OF THE INVENTION

Binaural rendering is a signal processing technique for creating stereo audio signals which, when delivered through headphones, are perceived by a user to originate from a real-world sound source at a specific spatial location. This technique can be applied to create very realistic auditory virtual realities for entertainment, gaming, and e-tourism purposes, as well as for more serious applications like education and training, remote telepresence, and spatial situation awareness displays. The fundamental technology for generating this virtual audio illusion is known as the head-related transfer function ("HRTF"), a set of user-specific filters which capture all perceptually relevant sound localization cues. When a user-specific HRTF cannot be used, general performance of the binaural rendering is degraded for the majority of users, an increase in large localization errors is observed, users exhibit poor sound source externalization, and a there is a perception of decreased sense of presence in the auditory virtual environment.

The measurement of an individualized HRTF is time and cost-prohibitive for the average potential user of binaural rendering technologies. Present technologies for measuring an HRTF for a given user require complex equipment, hard-to-find acoustically treated anechoic environments, or both, making widespread use of true individualized HRTFs impractical for most commercial applications. Instead, many researchers have proposed techniques for HRTF personalization where existing non-individualized HRTFs are either selected or customized based on a user's physical dimensions, subjective evaluation, or objective performance on an auditory task. While such techniques have exhibited certain performance benefits over one-size-fits-all generic HRTFs, no current technique based on personalization provides objective localization performance on par with an individually measured HRTF.

Thus, it would be advantageous to provide an improved methodology for selecting a HRTF for binaural rendering of audio signals that are perceived by a user to originate from a real-world spatial location.

SUMMARY OF THE INVENTION

The present invention overcomes the foregoing problems and other shortcomings, drawbacks, and challenges of obtaining an HRTF for binaural rendering without the conventional cost-prohibitive limitations or restrictions. While the invention will be described in connection with certain embodiments, it will be understood that the invention is not limited to these embodiments. To the contrary, this invention includes all alternatives, modifications, and equivalents as may be included within the spirit and scope of the present invention.

Embodiments of the present invention can provide personalized HRTF selection from among a data store containing a plurality of candidate HRTFs using an evaluation-based personalization strategy. That strategy, in part, can use one or more relational models to personalize the selection. These relational models can relate candidate HRTFs to each other and a particular user to other users so that only a subset of the candidate HRTFs require evaluation. Candidate HRTFs can be evaluated according to one or more selection policies, and relational models can be updated based on actual responses from a user to virtual audio signals that are rendered by a candidate HRTF.

In accordance with an embodiment of the present invention, there is provided a method for improved binaural rendering of audio signals that are perceived by a user to originate from a real-world spatial location. The method includes accessing, by a processor, a data store containing a plurality of candidate HRTFs. A candidate HRTF a location pairing is selected according to a selection policy for selecting a number of candidate HRTFs among the plurality of candidate HRTFs. A virtual audio signal is presented to the user via an apparatus for generating audio signals based on the candidate HRTF and the location pairing. Response data representative of the user's response to the presentation is acquired. A performance value of the user is predicted for each of a plurality of selected candidate HRTFs based on the response data for each candidate HRTF and location pairing. An optimal HRTF can thereby be selected to render the binaural signals for the user based upon the prediction. The prediction is terminated according to a stopping rule.

In accordance with a further embodiment of the present invention, the method includes computing a score for the candidate HRTF and the location pairing, where the score represents at least one of a raw response value and an error value determined by comparing a perceived location to a target location from which the virtual audio signal is presented to the user.

In accordance with an additional embodiment of the present invention, the predicting for each selected candidate HRTF includes: receiving performance data from the data store for all previous users with corresponding candidate HRTFs; applying the performance data to a current relational user model and a current relational HRTF model; and determining an expected performance level value for each candidate HRTF, where the value is at least one of a single value, a value with confidence bounds, and a range of values for the expected performance.

In accordance with still a further embodiment of the present invention, the relational user model includes a group of users, where users within the group are selected based on a previous performance level with candidate HRTFs.

In accordance with yet another embodiment of the present invention, the relational user model includes a group of users, where the users within the group are selected based upon distance-based relationships.

In accordance with another embodiment of the present invention, the relational HRTF model includes like HRTFs, where likeness is based upon the performance data from previous users.

In accordance with yet another embodiment of the present invention, the relational HRTF model includes groups of like HRTFs, where likeness is based upon continuous distance-based relationships.

In accordance with still another embodiment of the present invention, the relational user model and relational HRTF model are updated based upon the user's response to the selected candidate HRTFs and location pairing.

In accordance with another embodiment of the present invention, there is provided a computer program product including computer usable program code stored in a non-transitory memory medium for binaural rendering of audio signals that are perceived by a user to originate from a real-world spatial location. The computer usable program code is executed by a processor to cause the processor to implement the methodology described in the foregoing.

In accordance with still another embodiment of the present invention, there is provided a system for binaural rendering of audio signals that are perceived by a user to originate from a real-world spatial location. The system includes at least one processor and memory storing computer usable program code, which when executed by the at least one processor, causes an electronic device to execute the methodology described in the foregoing.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims

BRIEF DESCRIPTION OF THE DRAWINGS

The accompanying drawings, which are incorporated in and constitute a part of this specification, illustrate embodiments of the present invention and, together with a general description of the invention given above, and the detailed description of the embodiments given below, serve to explain the principles of the present invention.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION OF THE INVENTION

Figure 1:
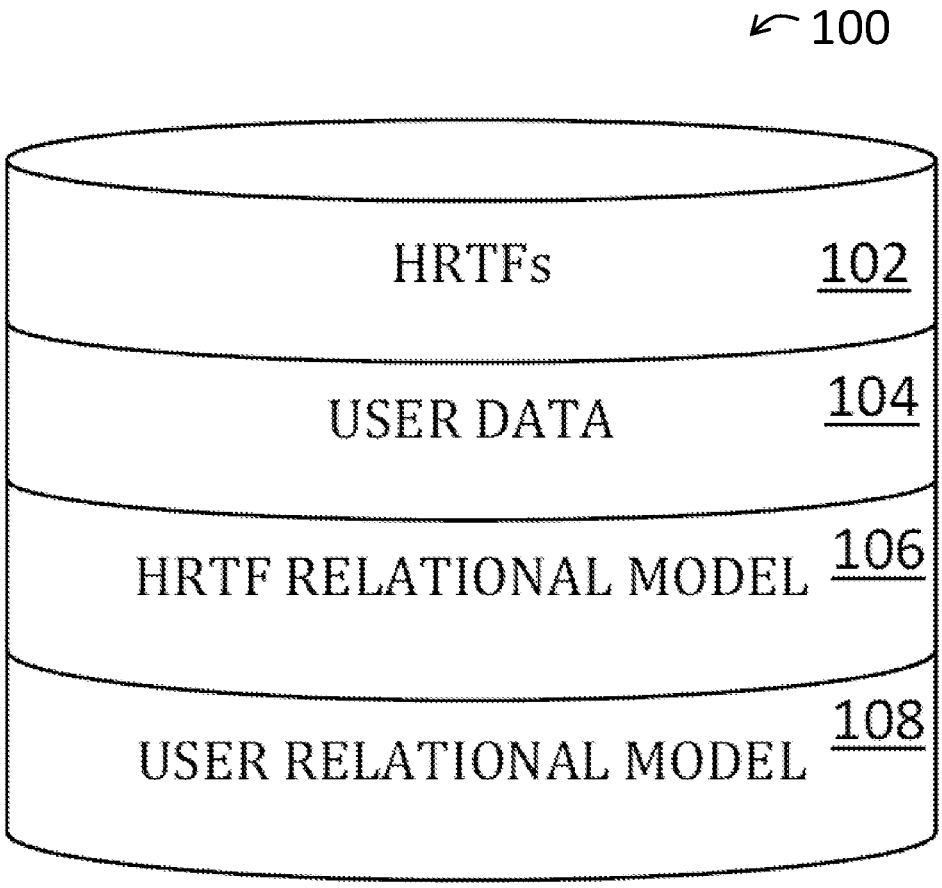
FIG. 1 is a high-level architecture for selecting a HRTF for binaural rendering of audio signals that are perceived by a user to originate from a real-world spatial location in accordance with an embodiment of the present invention.

Referring now to FIG. 1, there is depicted a high-level schematic of an architecture for a data store (i.e., database) 100 configured to store a plurality of candidate HRTFs 102 and a plurality of user data 104. The plurality of candidate HRTFs 102 may be embodied as a library having a large number of previously measured HRTFs and locations (an illustrative example may include 45 locations and more than 400 HRTFs). Thus, the candidate HRTFs 102 are associated with a large number of individuals and locations, the user data 104 from current and previous users of the embodiments of the present invention, and relational models 106, 108 for system user data 104 and candidate HRTFs 102.

Specifically, the database 100 includes an updatable HRTF relational model 106 comprising information pertaining to each candidate HRTF 102, such that the candidate HRTFs 102 may be arranged according to an HRTF relational criteria into one or more HRTF clusters. The database 100 may further include an updatable user relational model 108 that is configured and arranged according to user relational criteria into one or more user clusters. The user relational criteria are based on the plurality of user data 104 and may include performance data of current and previous users, as well as user and performance data for those users having a candidate HRTF 102 stored in the database 100.

More particularly, the user relational model 108 describes how each user (from which the candidate HRTFs 102 comprising the database 100 were previously measured or evaluated) relates to the respective user. The HRTF relational model 106 describes how each candidate HRTF 102 in the database 100 relates to all other candidate HRTFs 102 in the database 100. According to an embodiment of the present invention, the relationships may be in the form of clustering "like" candidate HRTFs 102 or "like" user data 104, wherein likeness is based on performances by users. According to another embodiment of the present invention, the relationship may be in the form of continuous distance-based relationships, such as simple correlations of behavioral responses for each performance by users. Unlike the user relational model 108, reasonable approximations of the HRTF relational model 106 may be made before any performance evaluations are completed for a new user. Reasonable approximations may include utilizing structural similarities of a plurality, a cluster, or other grouping of candidate HRTFs 102 as a proxy for behavioral information. Structural similarities may include, for example, distance matrices, wherein exemplary HRTF distance metrics may include a distance along a learned HRTF manifold, spectral distortion, error predicted by a computational localization model, and the like.

Figure 2:
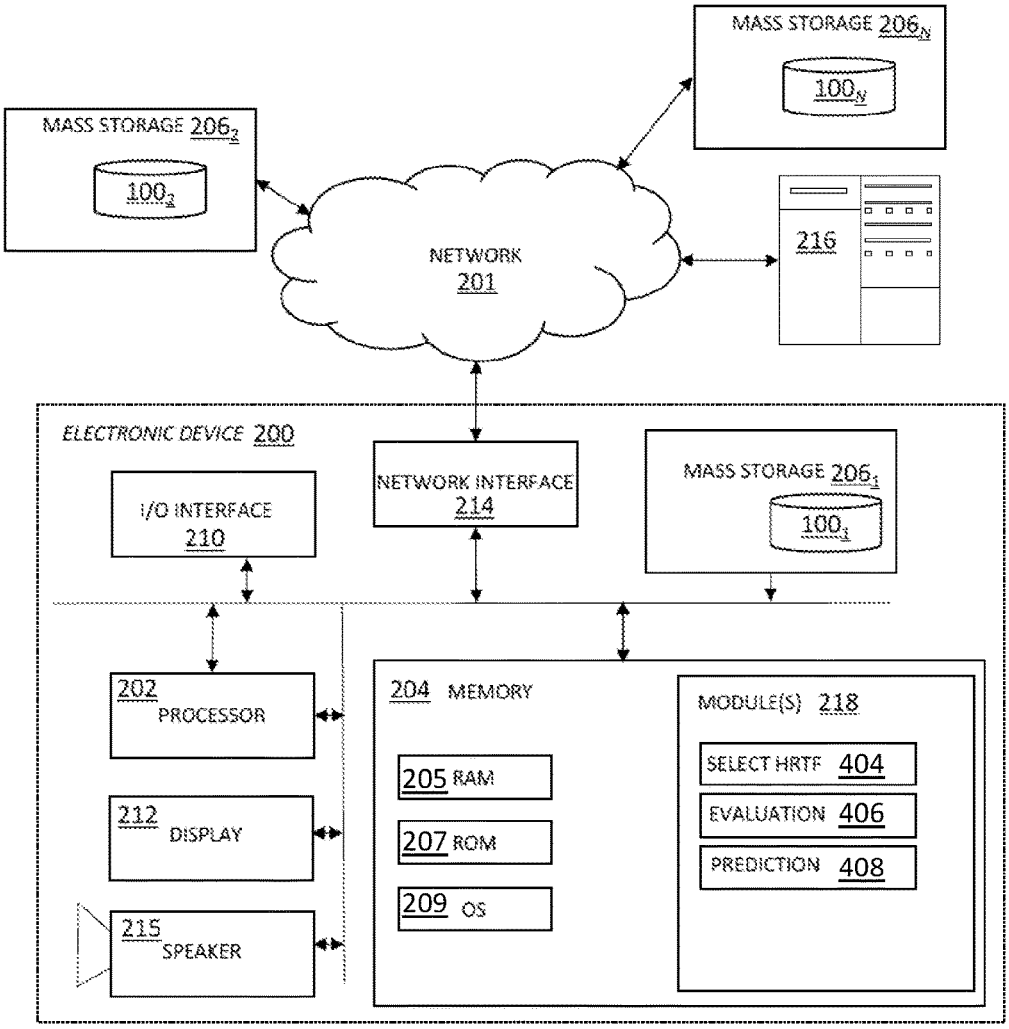
FIG. 2 is a representative electronic device for carrying out a method in accordance with an embodiment of the present invention.

Referring now to FIG. 2, there is depicted a schematic of an example electronic device 200 and networked environment for performing a method in accordance with an embodiment of the present invention. The illustrative electronic device 200 may encompass any type of computer, computer system, computing system, server, handheld device, networked device or the like. The electronic device 200 may be implemented with one or more networked computers using one or more communication networks 201, e.g., in a cluster or other distributed computing system through a network interface 214. The electronic device 200 may also include other suitable programmable electronic devices in accordance with embodiments of the present invention.

The electronic device 200 conventionally includes at least one processor 202 coupled to a memory 204, an input/output interface 210 configured to receive user input and convey information via a display 212, the network interface 214, and a speaker 215 for generating virtual audio signals for presentation to a user. The speaker 215 is shown generically and may refer to any type of sound generation device, including head-phones, a loudspeaker, or the like. The memory 204 may include random access memory 205 ("RAM"), such as dynamic random-access memory ("DRAM"), static random-access memory ("SRAM"), or non-volatile random-access memory 207 ("NVRAM"); persistent memory, e.g., read only memory ("ROM"), flash memory, at least one hard disk drive, and/or another digital storage medium. The electronic device may be provided with a first mass storage device 2061 containing a first database 1001 such as, for example, database 1000 illustrated in FIG. 1 and described above. The mass storage device 2061 may encompass at least one hard disk drive and may be disposed internally (as part of or separate from the memory 204) or externally to the electronic device 200, such as in a separate enclosure or in one or more networked computers, one or more networked storage devices (including, for example, a tape or optical drive), and/or one or more other networked devices such as, for example, a server 216. In accordance with a further embodiment, the database 100 (FIG. 1) may be a distributed database system composed of multiple databases that include the first database 1001 of the first mass storage device $\mathbf{206}_1$ with additional databases $\mathbf{100}_2$ . . . $\mathbf{100}_N$ in one or more mass storage devices $\mathbf{206}_2$ . . . $\mathbf{206}_N$ that are disparately disposed and accessible via the communications network 201.

The processor 202 may be, in various embodiments, a single-thread, multi-threaded, multi-core, and/or multi-element processing unit (not shown) as is well known in the art. In alternative embodiments, the electronic device 200 may include a plurality of processing units that may include single-thread processing units, multi-threaded processing units, multi-core processing units, multi-element processing units, and/or combinations thereof as is well known in the art. Similarly, the memory 204 may include one or more levels of data, instruction, and/or combination caches, with caches serving the individual processing unit or multiple processing units (not shown) as is well known in the art.

The memory 204 of the electronic device 200 may include one or more modules 218, or other software program(s), which are configured to execute in combination with an operating system 209 (OS) by processor 202 and automatically perform tasks necessary for performing methods in accordance with the present invention as described further below, with or without accessing further information or data from the database(s) 100 of the mass storage device $\mathbf{206}_1$.

Those skilled in the art will recognize that the environment illustrated in FIG. 2 is not intended to limit the present invention. Indeed, those skilled in the art will recognize that other alternative hardware and/or software environments may be used without departing from the scope of the invention.

Figure 3:
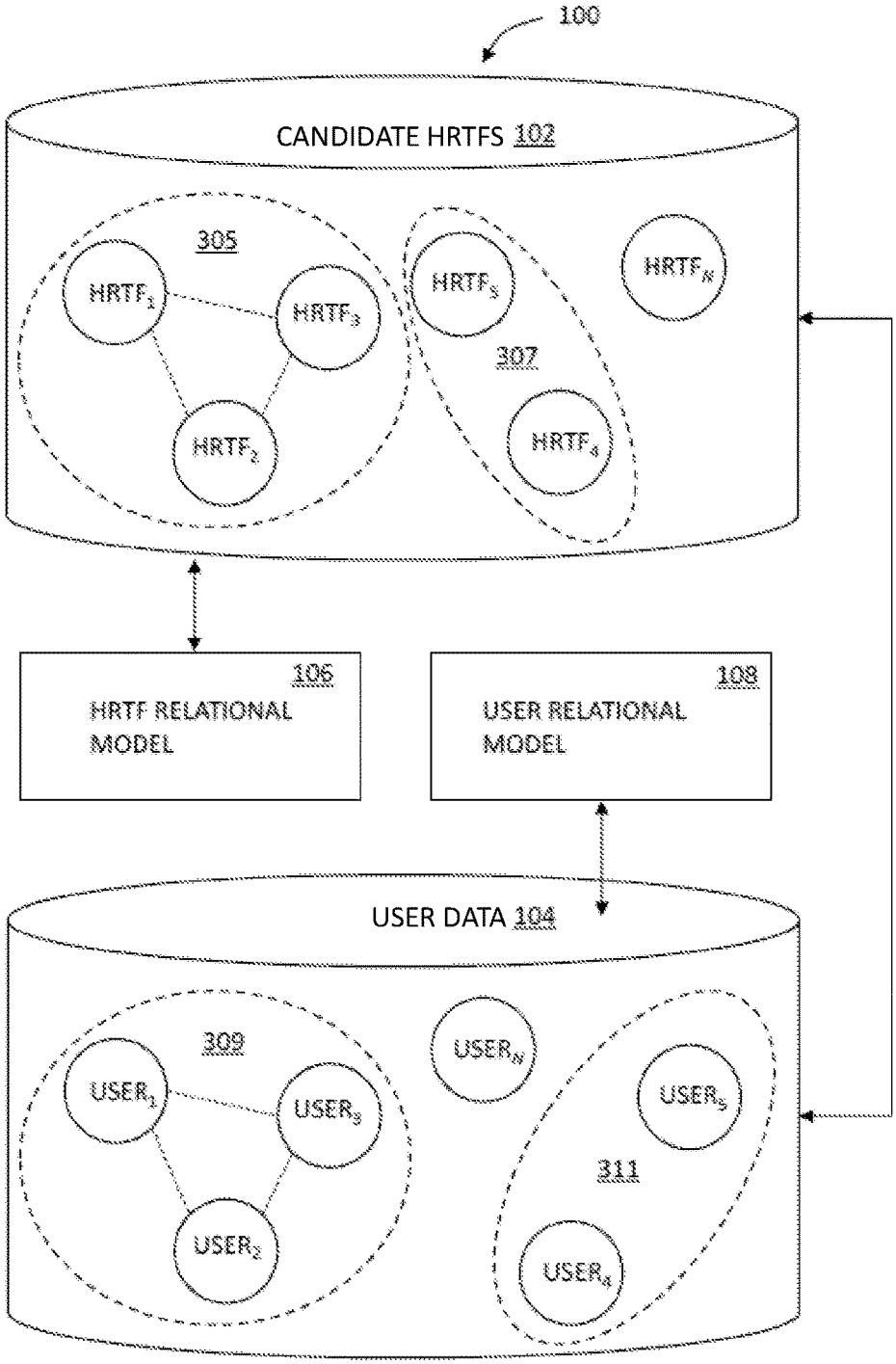
FIG. 3 is a block diagram of a database structure in accordance with an embodiment of the present invention.

Referring now to FIG. 3, further details of an example structure for the database 100 illustrated in FIGS. 1 and 2 are shown in accordance with an embodiment of the present invention. In FIG. 3, the plurality of candidate HRTFs 102 (each illustrated separately as $HRTF_1$, $HRTF_2$, $HRTF_3$, $HRTF_4$, $HRTF_5$, $HRTF_N$) may be correlated and thus arranged into two or more clusters 305, 307. The candidate HTRFs 102 are logically coupled to the HRTF relational model 106 as described above. Similarly, the plurality of user data 104 (each illustrated separately as $USER_1$, $USER_2$, $USER_3$, $USER_4$, $USER_5$, $USER_N$) may be correlated and also arranged into two or more clusters 309, 311 and is also coupled to both the user relational model 108 and the candidate HRTFs 102. Clustering may be based on correlations of behavioral responses for each performance by previous users as described above.

Figure 4:
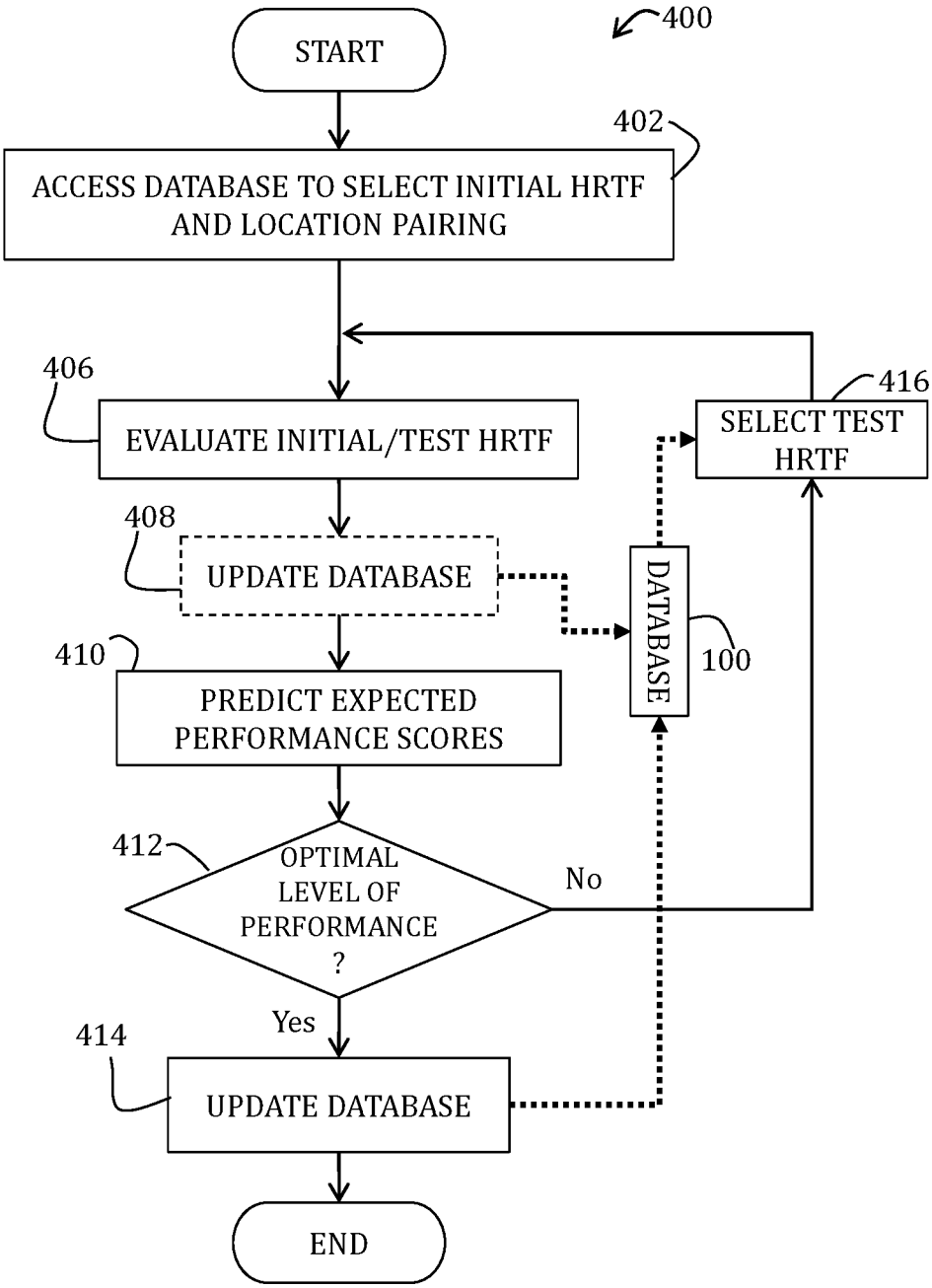
FIG. 4 is a method in accordance with an embodiment of the present invention.

Referring now to FIGS. 2-4, there is depicted a method 400 for selecting an optimal HRTF from the candidate HRTFs 102 for binaural rendering of audio signals that are perceived by a new user to originate from a real-world spatial location. As depicted in FIG. 4, and at start, the processor 202 accesses the plurality of candidate HRTFs within the database 100 for selecting an initial HRTF and location pairing (i.e., {HRTF, location}) from the candidate HRTFs 102 and according to a selection policy (Block 402). The initial HRTF may be selected at random from the candidate HRTFs 102, be a particular starting HRTF, be a composite HRTF generated from multiple HRTFs, or be an artificially manufactured HRTF, in accordance with an embodiment of the present invention. Otherwise a selection policy may be used, wherein an exemplary selection policy may include an Epsilon Greedy Policy, an Upper Confidence Bound Policy, or the like.

The initial HRTF and location pairing may be used to render a sound for the new user for the purpose of evaluating an appropriateness of the initial pair (Block 406). The evaluation, in accordance with an embodiment of the present invention, may include presentation of a virtual audio signal via the speaker 215 that has been rendered using the initial HRTF and location pair to the new user. The processor 202 acquires response data representative of the new user's response to the presentation of the virtual audio signal. The new user's response may be a localization, an indication of subjective quality, or an externalization of the presented virtually-rendered sound. The localization may include an indication of a perceived direction of the virtual audio signal (e.g., hand or head-pointing, a verbal report of coordinates, indication of location on a graphical display, etc.). An illustrative subjective quality judgment may refer to a response that the presented virtually-rendered sound was of either "good" or "bad" sound quality. Proper externalization may include an indication that the sound is perceived to originate from a location outside the new user's head; poorly rendered sounds might be perceived as originating from inside the new user's head.

The response data may then be used, by the processor 202, to compute an appropriateness score that may include raw response values or error values obtained by comparing a perceived location to the actual (or virtual) location used to render the virtual audio signal. For example, an angular error (such as in polar coordinates) may be computed between the actual location and the perceived location.

Optionally, the appropriateness scores, once computed, with or without response data, may be used to update the database 100 (Block 408).

The response data and appropriateness scores may then be used to predict an expected performance score for the new user with respect to other candidate HTRFs in the database 100 (Block 410) based on the HRTF and user relational models 106, 108. While every candidate HRTF 102 and every user data 104 may be used to render virtual audio signal for the new user, all embodiments of the present invention should not be so limited. Instead, one of ordinary skill in the art having the benefit of the disclosure herein would readily appreciate how clustering the candidate HRTFs 102 and the user data 104 according to the HRTF and user relational models 106, 108 (such as was illustrated in FIG. 2) may be used to define a suitable number of test HRTFs (that is another HRTF selected from the candidate HRTFs 102) and user data 104 for rendering and presenting virtual audio signal to the new user. In this regard, and assuming, for example, that across all previous users that the responses and appropriateness scores of a first user with first and second HRTFs (for example, $HRTF_1$ and $HRTF_2$) are highly correlated, then a second user having good response data and appropriateness scores with the first HRTF ($HRTF_1$) may be expected to have a similar response (i.e., the expected performance score) with the second HRTF ($HRTF_2$). Thus virtual audio signal need not be rendered and presented to the new user to actually evaluate the second HFTF ($HRFT_2$). As a result, the method 400 may be optimized and a suitable HRTF yielding good results for the second user may more quickly identified. Similarly, assuming a third user is highly correlated to a fourth user (similar with respect to physiology, anatomy, performance, for example) and that the third user achieved good responses data and appropriateness scores using a third HRTF ($HRTF_3$, for example, after 10 trials), then an expected performance score for a fourth user may be estimated using the same 10 trials as the third user. Again, such expectation optimizes the method 400 and obviates a need for repeated iteration of evaluations (that is, the looping between Decision Block 412 and Block 406). In other words, the expected performance score value may be estimated for non-evaluated HRTFs.

Still more particularly, and according to an embodiment of the present invention, the HRTF and user relational models 106, 108 may loaded into the processor 202 such that the expected performance score of the new user with respect to each candidate HRTF 102 in the HRTF database 100 (or certain HRTF clusters 305, 307), within a confidence boundary, may be calculated. The expected performance score may include, according to some embodiments, pairing of a candidate HRTF with location pair: {HRTF, location}.

According to one embodiment, the expected performance score may be estimated as an average of all users' response data and appropriateness score using the HRTF and user relational models 106, 108 with a presumption that each candidate HRTF 102 performs equally well to all HRTFs 102 within its respective cluster 309, 311 and that all users within a specific user cluster will perform equally well for a given candidate HRTF 102.

According to some embodiments of the present invention, the confidence boundary of the expected performance score for each candidate HRTF 102 may be computed using generalized confidence bounds or other confidence interval scheme that is configured to accurately model a distribution of expected performance scores. In general, the confidence boundary should decrease (i.e., the predictions should, qualitatively, improve) as more evaluations, trials, or iterations for more users are included in the calculations and recorded in the database 100.

Continuing, and based on selection criteria, each expected performance score may be evaluated for optimal level of performance (Decision Block 412). If the expected performance score yields suitable optimal results for the new user ("Yes" branch of Decision Block 412), then the associated expected performance score set may be output and the process may terminate. An optimal level of performance may include, at minimum, a greater value of the expected performance score. According to some embodiments of the present invention, the output of the expected performance score (the {HRTF, location} set) may be used to further populate the database 100 (Block 414) for future uses of the method 400 for future new users.

If the expected performance score (or no resulting expected performance scores for multiple candidate HRTFs 102) fails to yield an optimal level of performance ("No" branch of Decision Block 412), then the process continues by selecting a test HRTF from the candidate HRTFs 102 from the database 100 (Block 416) and returning for evaluation (Block 406). The selection criteria for the test HRTF may vary but may generally attempt to accommodate particular or specific goals of the new user. According to one embodiment of the present invention, such as when the new user desires satisfactory performance as quickly as possible (such as in real time performance of a task), the selection criteria may incorporate a solution selected from the group consisting of Multi-Armed Bandit problems. Solutions selected from this group may consider HRTF selection tradeoffs between an exploration for the best (or optimal) candidate HRTF 102 and an exploitation of a moderate HRTF to minimize total regret. Total regret may be a performance deficit (diminution of optimal results) achieved because a less than best (or most optimized) candidate HRTF 102 was used during every round of evaluation.

Alternatively, and according to another embodiment of the present invention, when the current user is not concerned with obtaining immediate of results (e.g., when time is available for dedicating to exploration without concern for total performance regret), then the selection criteria may incorporate a solution from the group consisting of Active Sampling Literature problems. The solution, selected from this group, may be used to select HRFTs that maximize information gained (or minimize information uncertainty) with each successive or repeated evaluations (that is, the iterations between Decision Block 412 and Block 406). Such methodology may be used to optimize capabilities of successive predictions (Block 410) and, therefore, increases a likelihood of selecting a best (optimized) HRTF from the database 100 after a given number of evaluations (for example, about 100 iterations in a short time frame, which may be less than 15 min).

For these two embodiments (Multi-Armed Bandit and Active Sampling Literature), an iterative estimate of the best HRTF for the new user may not be the test HRTF selected for a next, iterative cycle ("No" branch of Decision Block 412 returning to Block 406). In fact, according to still other embodiments of the present invention, additional selection policy or policies may, optionally, be incorporated for selecting the test HRTF at random. Such random selection of the test HRTF, while less optimal, may provide at least incremental improvement over iterative or other methodical selection policies due to the influence of the predictions (Block 410), which is described in greater detail below.

Referring again to FIG. 4, with the test HRTF now chosen (Block 416), the test HRTF returns to evaluation (Block 406) to be assessed in the manner described above with the initial HRTF (only here replacing the initial HRTF with the test HRTF), and the process continues. As noted above, when the optimal {HRTF, location} set is output to update the database 100 (Block 414), the process proceeds to termination.

The decision whether to conduct additional iterations (Decision Block 412) may be conducted according to a stopping rule, which may include a predetermined or set number of iterations, whether the test HRTF has achieved some preset performance threshold with some preset or threshold predicted level of confidence, whether an optimal stopping procedure is met (for example, stopping when a change in probability of the best HRTF during subsequent trials falls below a preset probability), or a combination thereof If the method 400 is terminated according to the stopping rule, then the test HRTF with the best expected performance score is output. Otherwise, the process continues to selection of yet another test HRTF (Block 416) and returns for further evaluation (Block 406).

Figure 5:
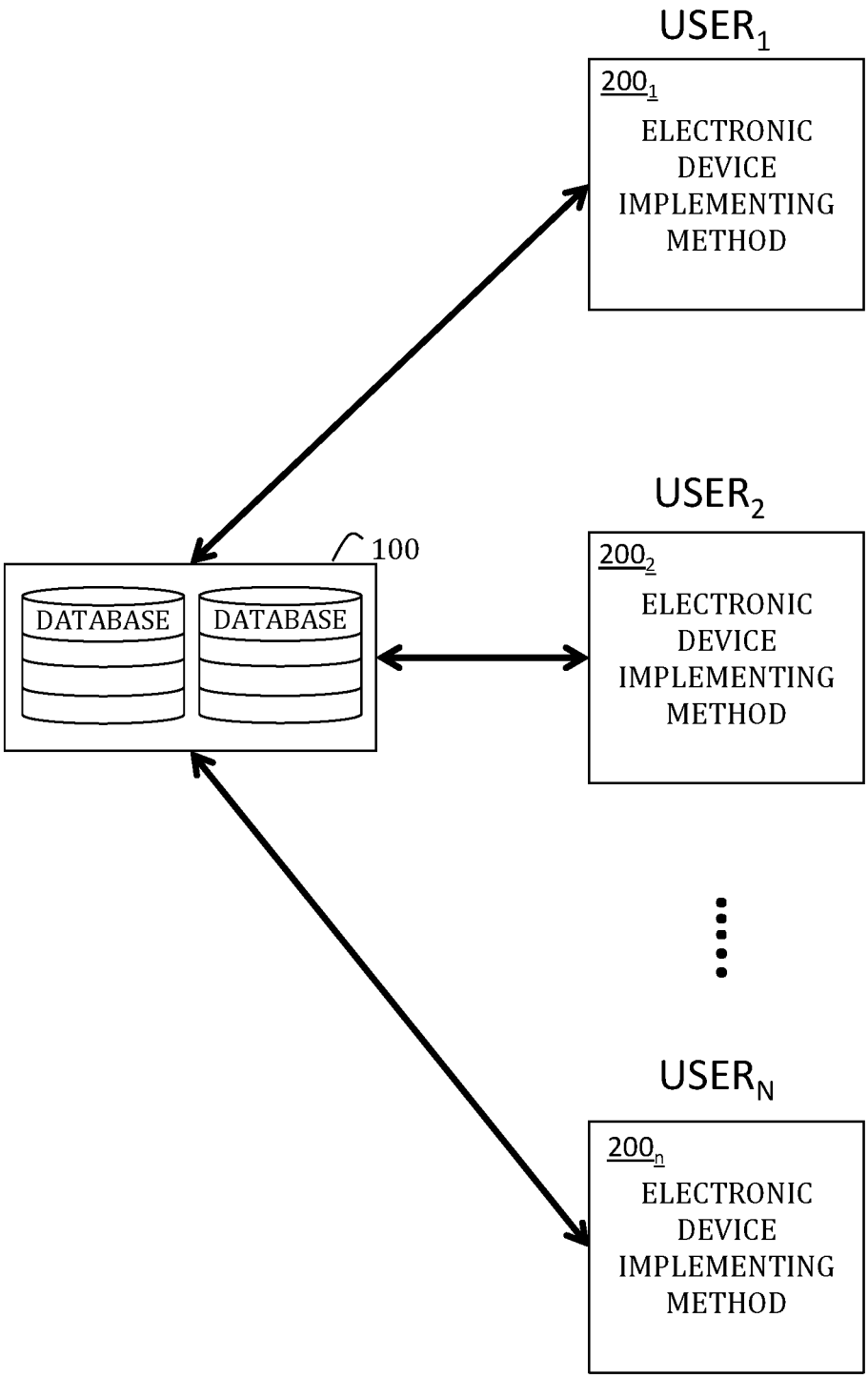
FIG. 5 a general flow diagram for creating a collaborative environment by which a database of candidate HRTFs and user data may be expanded to improve performance in selecting an optimal HRTF in accordance with an embodiment of the present invention.

With reference now to FIG. 5, a general flow diagram for creating a collaborative environment by which the database 100 may be expanded for improved capabilities associated with the method 400 (FIG. 4) described above is described. In particular, the database 100 may be configured, such as via the network interface 214 (FIG. 2), cloud computer, or other mass storage $\mathbf{206}_2 \ldots \mathbf{206}_N$, to enable accessibility by multiple facilities, users, or both. As a result, implementing methods according to embodiments of the present invention permit predictions, evaluations, response data, expected performance score, {HRTF, location}, and other information to be stored and accessible for any number of users (illustrated as $USER_1$, $USER_2$, $USER_N$). As the plurality of candidate HRTFs 102 and the plurality of user data 104 contained within the database 100 gets larger, a better selection of a best or optimal HRTF for a new user may be achieved.

The embodiments of the present invention, as provided herein, may be used prior to, or as part of, the use of any HRTF-based binaural audio rendering system, including those used in informational auditory displays, entertainment, virtual or augmented reality, gaming, etc. HRTFs selected via an embodiment of the present invention may then be imported into the binaural rendering system and used for improved performance.

If virtual audio signals are replaced with physical loudspeakers (or virtual simulations based on the device/settings), then some embodiments of the present invention may be used to select appropriate, commercially-available hearing aids, hearing protectors, communication headsets, or settings thereof. Selection may be based, at least in part, on impact to auditory performance.

Furthermore, according to other embodiments of the present invention, and considering a method of conducting a small number of localization trials using every HRTF in a given HRTF database, then, with a large enough HRTF database, it may be virtually guaranteed that the candidate HRTF will satisfy localization accuracy criteria for the user. However, with the addition of a new HRTF to the HRTF database, the time and cost of conducting the evaluation increases. Conversely, if a HRTF database is constructed to consist of a small number of representative HRTFs, then the evaluation may proceed relatively quickly for all candidate HRTFs, but the likelihood of the best HRTF satisfying localization accuracy criteria for the current user decreases. As such, one of ordinary skill in the art having the benefit of the disclosure here may construct an evaluation-based personalization strategy to include as many candidate HRTFs as possible, while minimizing the number of HRTFs to be evaluated directly for the current user.

While the present invention has been illustrated by a description of one or more embodiments thereof and while these embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

The invention claimed is:

1. A method for binaural rendering of audio signals that are perceived by a user to originate from a real-world spatial location, comprising:

accessing, by a processor, a data store containing a plurality of candidate Head-Related Transfer Functions (HRTFs) and location pairs;

selecting, by the processor, a first HRTF and location pair from the plurality of candidate HRTFs and location pairs;

presenting a first virtual audio signal to the user via an apparatus configured to generate the first virtual audio signal using the first HRTF and location pair;

acquiring response data representative of the user's response to the presentation of the first virtual audio signal;

predicting, by the processor, an expected performance score for the user for candidate HRTFs and location pairs of the plurality based on the response data for the first HRTF and location pair; and selecting, from the expected performance scores, an optimal HRTF and location pair to render the binaural signals for the user.

2. The method according to claim 1, further comprising:

computing an appropriateness score for the first HRTF and location pair, the appropriateness score representing a raw response value, an error value, or both, as determined by comparing a perceived location represented by the response data to a target location from which the first virtual audio signal is presented to the user.

3. The method according to claim 1, wherein predicting the expected performance score comprises:

receiving performance data from the data store for all previous users with corresponding candidate HRTFs;

applying the performance data to a current user relational model and a current HRTF relational model; and determining the expected performance score for each candidate HRTF, the expected performance score being at least one of a single value, a value with confidence bounds, and a range of values for the expected performance.

4. The method according to claim 3, wherein the user relational model comprises a group of users, where users within the group are selected based on a previous performance level with candidate HRTFs or based upon distance-based relationships.

5. The method according to claim 3, wherein the HRTF relational model comprises groups of like HRTFs, where likeness is based upon the performance data from previous users or based upon continuous distance-based relationships.

6. The method according to claim 3, further comprising:

updating the user relational model and HRTF relational model based upon the expected performance score for each selected candidate HRTF and location pair of the plurality.

7. The method according to claim 1, further comprising:

selecting, by the processor, a second HRTF and location pair from the plurality;

presenting a second virtual audio signal to the user via an apparatus configured to generate the second virtual audio signal using the second HRTF and location pair;

acquiring response data representative of the user's response to the presentation of the second virtual audio signal;

predicting, by the processor, an expected performance score for the user for candidate HRTFs and location pairs of the plurality based on the response data for the second HRTF and location pair; and comparing the expected performance scores predicted from the second HRTF and location pair to the expected performance scores predicted from the first HRTF and location pair.

8. A computer program product comprising computer usable program code stored in a non-transitory memory medium for binaural rendering of audio signals that are perceived by a user to originate from a real-world spatial location, comprising:

computer usable program code, which when executed by a processor, causes the processor to access a data store containing a plurality of candidate Head-Related Transfer Functions (HRTFs) and location pairs;

computer usable program code, which when executed by the processor, causes the processor to select a first HRTF and location pair from the plurality of candidate HRTFs and location pairs;

computer usable program code, which when executed by the processor, causes the processor to signal a device to present a first virtual audio signal to the user via an apparatus configured to generate the first audio signals based on the first HRTF and location pair;

computer usable program code, which when executed by the processor, causes the processor to acquire response data representative of the user's response to the presentation of the first virtual audio signal;

computer usable program code, which when executed by the processor, causes the processor to predict an expected performance score of the user for candidate HRTFs and location pairs of the plurality based on the response data for the first HRTF and location pair; and computer usable program code, which when executed by the processor, causes the processor to select an optimal HRTF and location pair from the expected performance scores to render the binaural signals for the user based upon the prediction.

9. The computer program product according to claim 8, further comprising:

computer usable program code for computing an appropriateness score for the first HRTF and the location pair, the appropriateness score representing a raw response value, an error value, or both, as determined by comparing a perceived location represented by the response data to a target location from which the first virtual audio signal is presented to the user.

10. The computer program product according to claim 8, wherein predicting the expected performance score comprises:

receiving performance data from the data store for all previous users with corresponding candidate HRTFs;

applying the performance data to a current user relational model and a current HRTF relational model; and determining the expected performance score for each candidate HRTF, the expected performance score being at least one of a single value, a value with confidence bounds, and a range of values for the expected performance.

11. The computer program product according to claim 10, wherein the user relational model comprises a group of users, where users within the group are selected based on previous performance with candidate HRTFs or based upon distance-based relationships.

12. The computer program product according to claim 10, wherein the HRTF relational model comprises groups of like HRTFs, where likeness is based upon the performance data from previous users or based upon continuous distance-based relationships.

13. The computer program product according to claim 10, further comprising:

updating the relational user model and relational HRTF model based upon the performance value for each selected candidate HRTF and location pairing.

14. The computer program product according to claim 8, wherein the computer usable program code, which when executed by the processor, causes the processor to also select a second HRTF and location pair from the plurality of candidate HRTFs and location pairs;

the computer usable program code, which when executed by the processor, causes the processor to also signal the device to present a second virtual audio signal to the user via an apparatus configured to generate the second audio signals based on the second HRTF and location pair;

the computer usable program code, which when executed by the processor, causes the processor to also acquire response data representative of the user's response to the presentation of the second virtual audio signal;

the computer usable program code, which when executed by the processor, causes the processor to also predict an expected performance score of the user for candidate HRTFs and location pairs of the plurality based on the response data for the second HRTF and location pair; and the computer usable program code, which when executed by the processor, causes the processor to also compare the expected performance scores predicted from the second HRTF and location pair to the expected performance scores predicted from the first HRTF and location pair.

15. A system for binaural rendering of audio signals that are perceived by a user to originate from a real-world spatial location, comprising:

at least one processor;

memory storing computer usable program code, which when executed by the at least one processor, causes an electronic device to:

access a data store containing a plurality of candidate Head-Related Transfer Functions (HRTFs) and location pairs;

select a first HRTF and location pair from the plurality of candidate HRTs and location pairs;

present a first virtual audio signal to the user via an apparatus configured to generate audio signals based on the first HRTF and the location pair;

acquire response data representative of the user's response to the presentation of the first virtual audio signal;

predict an expected performance score of the user for candidate HRTFs and location pairs of the plurality based on the response data for the first HRTF and location pair; and select, from the expected performance scores, an optimal HRTF and location pair to render the binaural signals for the user.

16. The system according to claim 15, wherein memory storing computer usable program code, which when executed by the at least one processor, causes the electronic device to also:

compute an appropriateness score for the first HRTF and location pair, the appropriateness score representing a raw response value, an error value, or both, as determined by comparing a perceived location represented by the response data to a target location from which the first virtual audio signal is presented to the user.

17. The system according to claim 15, wherein predicting the expected performance score comprises:

receiving performance data from the data store for all previous users with corresponding candidate HRTFs;

applying the performance data to a current user relational model and a current HRTF relational model; and determining the expected performance score for each candidate HRTF, the expected performance score being at least one of a single value, a value with confidence bounds, and a range of values for the expected performance.

18. The system according to claim 17, wherein the user relational model comprises a group of users, where users within the group are selected based on a previous performance level with candidate HRTFs or based upon distance-based relationships.

19. The system according to claim 17, wherein the HRTF relational model comprises groups of like HRTFs, where likeness is based upon the performance data from previous users or based upon continuous distance-based relationships.

20. The system according to claim 15, wherein memory storing computer usable program code, which when executed by the at least one processor, causes the electronic device to also:

select a second HRTF and location pair from the plurality of candidate HRTs and location pairs;

present a second virtual audio signal to the user via an apparatus configured to generate audio signals based on the second HRTF and the location pair;

acquire response data representative of the user's response to the presentation of the second virtual audio signal;

predict an expected performance score of the user for candidate HRTFs and location pairs of the plurality based on the response data for the second HRTF and location pair; and compare the expected performance scores predicted from the second HRTF and location pair to the expected performance scores predicted from the first HRTF and location pair.

* * * * *